US006896735B2

(12) United States Patent
Giuliano et al.

(10) Patent No.: US 6,896,735 B2
(45) Date of Patent: May 24, 2005

(54) INTEGRATED CHARGE RING

(75) Inventors: Stefano Giuliano, Gerlingen (DE); Peter Marquardt, Steinheim (DE)

(73) Assignee: Behr Systems, Inc., Auburn Hills, MI (US)

( * ) Notice: Subject to any disclaimer, the term of this patent is extended or adjusted under 35 U.S.C. 154(b) by 181 days.

(21) Appl. No.: 10/713,909

(22) Filed: Jan. 24, 2003

(65) Prior Publication Data

US 2004/0255849 A1 Dec. 23, 2004

(30) Foreign Application Priority Data

Jan. 24, 2002 (DE) ..... 102 02 711

(51) Int. Cl.[7] ..... B05C 5/02

(52) U.S. Cl. ..... 118/629; 118/50.1; 118/620; 239/703; 239/706; 239/708

(58) Field of Search ..... 118/50.1, 620, 118/629; 239/703, 704, 706, 708, 690; 427/480, 484

(56) References Cited

U.S. PATENT DOCUMENTS

| | | | | |
|---|---|---|---|---|
| 4,376,135 A | | 3/1983 | Patel et al. | 427/31 |
| 4,521,462 A | | 6/1985 | Smythe | 427/421 |
| 4,572,437 A | | 2/1986 | Huber et al. | 239/703 |
| 4,589,597 A | | 5/1986 | Robisch et al. | 239/703 |
| 4,684,064 A | | 8/1987 | Kwok | 239/223 |
| 4,715,314 A | | 12/1987 | Ramseier et al. | 118/632 |
| 4,852,810 A | | 8/1989 | Behr et al. | 239/703 |
| 4,872,616 A | * | 10/1989 | Behr et al. | 239/703 |
| 4,919,333 A | | 4/1990 | Weinstein | 239/223 |
| 4,927,081 A | | 5/1990 | Kwok et al. | 239/223 |
| 4,944,459 A | | 7/1990 | Watanabe et al. | 239/305 |
| 4,955,960 A | | 9/1990 | Behr et al. | 239/3 |
| 5,011,086 A | | 4/1991 | Sonnleitner et al. | 239/691 |
| 5,078,321 A | | 1/1992 | Davis et al. | 239/224 |
| 5,127,125 A | | 7/1992 | Skibowski | 15/104.61 |
| 5,294,217 A | | 3/1994 | Talacko et al. | 406/91 |
| 5,300,006 A | | 4/1994 | Tanaka et al. | 483/56 |
| 5,397,063 A | | 3/1995 | Weinstein | 239/703 |
| 5,622,563 A | | 4/1997 | Howe et al. | 118/620 |

(Continued)

FOREIGN PATENT DOCUMENTS

| | | | |
|---|---|---|---|
| DE | 41 05 116 A 1 | 8/1992 | B05B/5/04 |
| DE | 43 42 128 A1 | 6/1995 | B05B/12/02 |
| DE | 196 10 588 A 1 | 9/1997 | B05B/13/02 |
| DE | 197 09 988 A 1 | 10/1998 | B05B/12/00 |
| DE | 197 42 588 A1 | 4/1999 | B05D/1/00 |
| DE | 198 30 029 A 1 | 1/2000 | B05B/12/14 |
| DE | 199 09 369 A 1 | 9/2000 | B05B/5/04 |
| DE | 199 37 425 A 1 | 3/2001 | B05B/7/24 |
| DE | 100 33 986 A 1 | 1/2002 | B05B/15/00 |
| DE | 100 63 234 C 1 | 7/2002 | F16L/11/22 |
| DE | 101 30 173 A 1 | 1/2003 | B05B/12/14 |
| EP | 0 283 918 B1 | 3/1988 | B05B/5/04 |
| EP | 0 171 042 B1 | 7/1988 | B05B/5/04 |
| EP | 0 238 031 B1 | 10/1990 | B05B/5/04 |
| EP | 0 767 005 A1 | 4/1997 | B05B/5/04 |
| EP | 0 801 991 A3 | 8/1998 | B05B/5/04 |
| EP | 0 904 848 A1 | 3/1999 | B05B/12/14 |
| EP | 0 967 016 A1 | 12/1999 | B05B/3/10 |
| EP | 1 108 475 A2 | 6/2001 | B05B/5/16 |
| EP | 1 114 677 A1 | 7/2001 | B05B/12/14 |
| EP | 1 118 388 A1 | 7/2001 | B05B/5/04 |
| EP | 0 796 663 B1 | 8/2001 | B05B/5/04 |
| EP | 1 172 152 A1 | 1/2002 | B05B/12/14 |
| WO | WO 94/22589 | 10/1994 | B05B/5/00 |

*Primary Examiner*—Laura Edwards
(74) *Attorney, Agent, or Firm*—Howard & Howard

(57) ABSTRACT

For improving external charging in electrostatic atomizers for conductive coating material and for reducing the structural size of the atomizer, particularly for robot applications, the charging electrodes are embedded in a ring part made of insulating material, which is set directly on the outside of the outer housing or forms a part of the outer housing.

13 Claims, 5 Drawing Sheets

U.S. PATENT DOCUMENTS

| | | | | | |
|---|---|---|---|---|---|
| 5,633,306 | A | | 5/1997 | Howe et al. | 524/409 |
| 5,662,278 | A | | 9/1997 | Howe et al. | 239/700 |
| 5,683,032 | A | | 11/1997 | Braslaw et al. | 239/7 |
| 5,704,977 | A | | 1/1998 | Baumann et al. | 118/323 |
| 5,775,598 | A | * | 7/1998 | Takayama et al. | 239/703 |
| 5,865,380 | A | | 2/1999 | Kazama et al. | 239/704 |
| 6,037,010 | A | | 3/2000 | Kahmann et al. | 427/421 |
| 6,090,450 | A | | 7/2000 | Kahmann et al. | 427/421 |
| 6,508,610 | B2 | | 1/2003 | Dietrich | 406/13 |
| 6,565,021 | B2 | * | 5/2003 | Borner et al. | 239/703 |
| 6,589,348 | B2 | | 7/2003 | Ott | 118/684 |

* cited by examiner

INTEGRATED CHARGE RING

FIELD OF THE INVENTION

The invention concerns an atomizer for electrostatic series coating of workpieces, such as vehicle chassis, using side and roof machines and painting robots.

BACKGROUND OF THE INVENTION

If the workpieces are to be coated with conductive material, such as water-based paint, in many cases the electrostatic atomizers operate in a known way with external charging, such that the atomizer cones or other spraying heads, which are set to a high voltage in direct or contact charging, can be grounded and thus need not be insulated from the grounded paint supply system, which would require the likewise generally known, relatively expensive potential insulation system. In other cases, external charging can also be preferred over direct charging for other reasons or they can be combined, e.g., in order to improve the application efficiency, which is defined as the ratio of the amount of particles deposited on the workpiece to the amount of sprayed particles (DE 4105116).

For a high-speed rotary atomizer of the class mentioned above known from EP 0238031, the needle-shaped electrodes sit in a circular ring body made of insulating material, which surrounds the external housing of the atomizer at a negligible radial distance and for this purpose is held by supports projecting in the radial direction from the external housing. This construction has not proven itself in practice because, among other things, it is too bulky. In addition, attempts have been made to increase the tracking current or surface path between the electrode tips by embedding the electrodes in pins extending like fingers (FIG. 3 of EP 0238031; EP 0283918). In a refinement of this pin construction, for today's conventional atomizers using external discharge, the electrodes are arranged in elongated insulating bodies, which extend from a ring body set directly on a rear part of the external housing in the axial direction towards the workpieces to be coated, wherein here the ionizing ends of the electrodes are also arranged at a considerable radial distance from the outer side of the housing (Dürr/Behr, Technisches Handbuch [Technical Handbook], Einführung in die Technik in die PKW-Lackierung [Introduction to the technology of automobile painting], Apr. 4, 1999; EP 0767005; DE 19909369 etc.). Apart from the fact that only a small number of electrodes can be distributed around the atomizer axis due to construction and other reasons, such as due to cleaning problems, these conventional electrode holder constructions also have the disadvantage that they limit the motion and operation possibilities for coating systems with painting robots due to their bulky outer shape, e.g., because narrow angular or inner regions of the workpieces are hard to reach or cannot be reached at all, or because they hinder the changing of atomizers, which is desired in many coating systems, in automatic changing stations.

Another problem of the known atomizer of the considered type, however, is that most significantly, the electrode tips arranged far outside the spray head in the radial direction tend to become contaminated, particularly through self-coating. This is not only undesired due to the risk of contamination of the workpieces to be coated through paint and other particles that are later freed, but also because the contamination has a negative effect on the electric field, which has the result of reducing the application efficiency and consequently much stronger self-coating. A weakened field can also be caused by overspray particles, i.e., paint droplets which are sprayed past the workpiece and then "stray," and which can be deposited on the electrode tips of the atomizer moving through the overspray cloud. Due to the weakened field, even more particles can reach the electrodes until finally the ionization of the surrounding air by the corona effect of the electrodes is more or less stopped. In addition, the contamination can lead to electrical arcing and other defects. For these reasons, the electrodes must be regularly cleaned at short time intervals with the result of undesired operating interruptions. The time, work, device, and material expense is also undesired for the cleaning, wherein the mentioned pin-like electrode holder constructions have proven to be a hindrance for both manual and also automatic cleaning.

The invention is based on the problem of presenting an electrostatic atomizer, which is also suitable for coating systems using painting robots, which is as small as possible, and which enables better application efficiency than before in a simple way, particularly without frequent cleaning.

This problem is solved by the features of the claims.

SUMMARY OF INVENTION

In contrast to the mentioned, known atomizers, no finger-like projections, pin-like extending holders, or spoke-like supports are provided for the electrodes. Instead of conventional electrode holders, the charging electrodes are integrated directly in or on the housing without gaps or outer distance between their ionization ends and the outside of the atomizer housing.

Surprisingly, the tendency of the spraying towards self-coating of the electrode tips is reduced by the invention and consequently both the application efficiency and also the usable operation period of the atomizer is improved. One possible reason for this is the greater proximity of the ionization ends of the electrodes to the spraying edges of the atomizer cones of a rotary atomizer (or to the nozzle opening of other atomizers) with the consequence that the sprayed paint particles are charged quickly and reliably in a region of high field-line concentration and correspondingly strongly ionized air before they are far from the atomizer head. Because the density of the field lines is greatest at sharp edges and tips, the ability to charge the paint particles decreases with increasing distance from the electrodes and from the atomizer head. In addition, the paint droplets become increasingly more dry corresponding to their distance from the atomizer head, also due to the guidance air for guidance of the atomizer stream from the atomizer to the sprayed coating material, which reduces the ability to charge the droplets. However, according to the invention it is possible to supply the paint close to the atomizer head, thus in a still wet and therefore easy to charge state at the greatest possible field-line concentration.

One particular advantage of the invention is that it achieves good application efficiency and low self-coating tendency by means of a compact construction without the conventional electrode holder projecting from the housing. This compact, outer form is favorable above all for electrostatically supported robot painting of workpiece areas that are hard to reach and above all for workpiece interior spaces and also enables both a manual or automatic cleaning of the atomizer and also automatic changing of the atomizer or its atomizer head in a corresponding changing station. Furthermore, the dynamic movability on a robot and other coating machines is improved by the compact construction and the low mass of the atomizer. The invention is suitable for electrostatic high-speed rotary atomizers and for electrostatically supported air atomizers and enables even better than before a meaningful alternative to the expensive potential focusing systems for electrostatic coating with conductive coating material, such as water-based paint.

Because the number of charging electrodes can be significantly greater, e.g., than the only six outer electrodes of today's conventional rotary atomizers, due to the arrangement of charging electrodes directly on or in the housing, the invention further produces a uniform spray pattern. Simultaneously, the application efficiency increases with the possible number of charging electrodes, because the corona effect of many electrodes can charge more air molecules, which can transfer their charge to the coating material.

BRIEF DESCRIPTION OF THE DRAWINGS

Other advantages of the present invention will be readily appreciated as the same becomes better understood by reference to the following Detailed Description when considered in connection with the accompanying drawings.

DETAILED DESCRIPTION OF THE INVENTION

Figure 1:
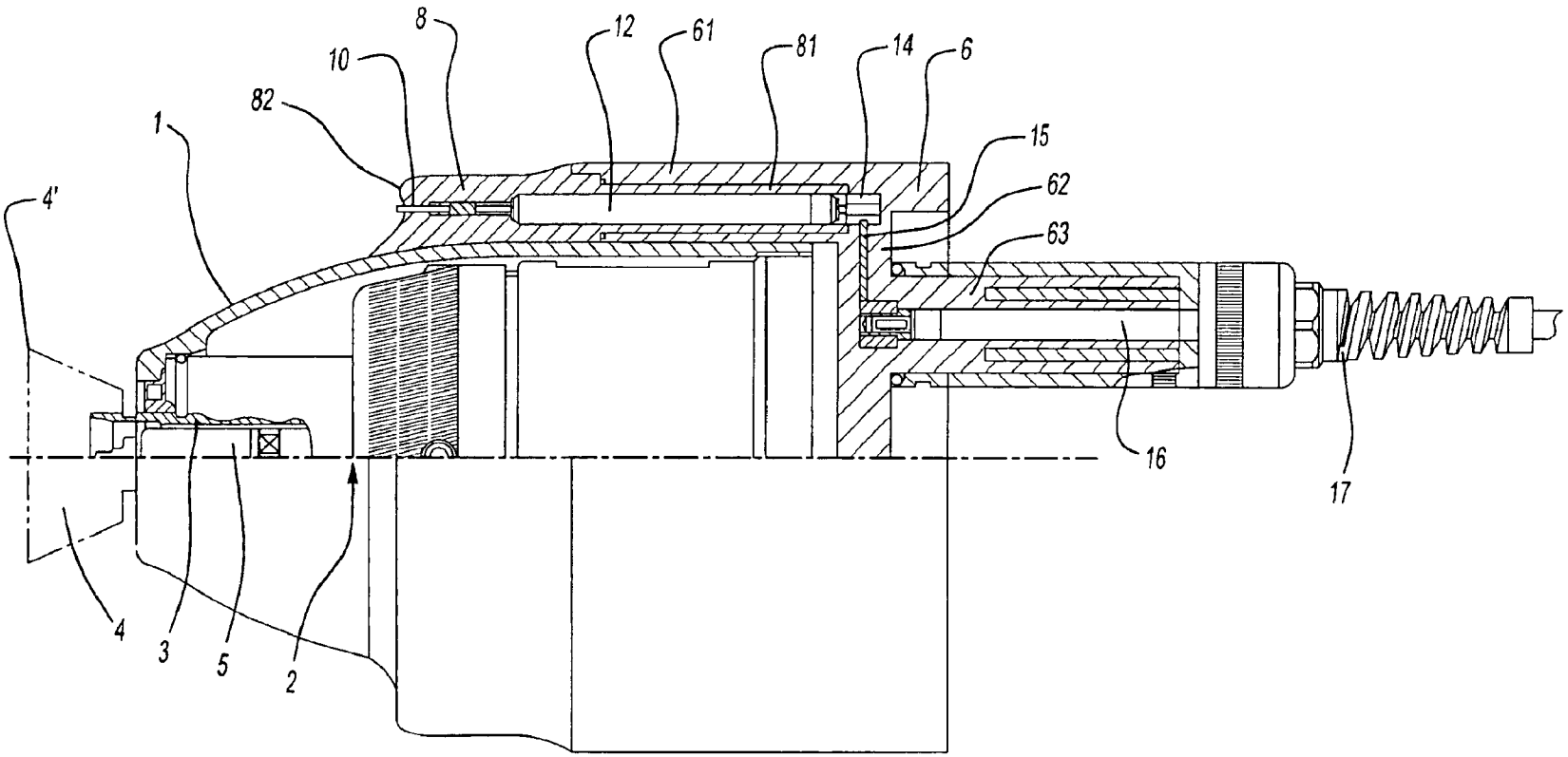
FIG. 1, the partial section of an electrostatic rotary atomizer.

In a known and conventional way, the high-speed rotary atomizer shown schematically in FIG. 1 contains in its outer housing body 1 with the illustrated, essentially hollow cylindrical shape a turbine 2 driven with compressed air. The cone plate rotating in front of the front end of the housing body 1 is mounted on the hollow shaft 3 of this turbine 2. The line for the coating material to the cone plate 4 runs through the hollow shaft 3 in a known way in an paint tube construction 5.

A holder body 6 for a high-voltage supply device is set on the rear end of the housing body 1. This holder body 6 surrounds the housing body 1 with its cylindrical ring part 61 concentrically, and on its end wall 62 running in the radial direction a high-voltage cable holder 63 is set outwards in the axial direction.

On the side of the housing body 1 facing the cone plate 4, a ring body 8 is seated in the peripheral area of the housing body 1 adjacent to the holder body 6, on whose rear end a projection 81 is formed with holes distributed uniformly around the axis of rotation of the atomizer. This projection 81 extends axially parallel into the holder body 6. The outer surfaces of the ring body 8 and the holder body 6 form a continuous and gap-less transition. The housing body 1, the ring body 8, and the holder body 6 consist of insulating material. In particular, the bodies 1 and 6, but also the ring body 8 can consist of PTFE, which is considerably less likely to become contaminated due to its surface properties.

Although the cone plate 4 of an atomizer of the illustrated type can be used for direct charging at an advantageous high voltage, it is assumed here that the coating material sprayed in the radial direction from its rotating edge is initially uncharged and is charged by an electric field outside of the atomizer. For this purpose, a collar of needle electrodes 10 surrounding the axis of rotation is embedded in the ring body 8 on a concentric circle at uniform angle intervals. The electrodes 10 for the illustrated example lie at the front end of the atomizer and thus the tips facing the workpiece to be coated are parallel to the axis of rotation. Instead, the electrodes 10 can also be arranged at an incline against or facing away from the direction of the axis of rotation.

Advantageously, the electrodes 10 can be embedded so that the ends of their tips are flush without gaps (without recesses) with the end surfaces 82 or other surface of the insulating ring part surrounding the ends, thus here the ring body 8, so that the electrode 10 tips are not contaminated and the possibly necessary cleaning of the surrounding surface areas of the ring body 8 is not hindered. Here, one possibility is to form the ring body 8 or its surface 82 in the region of the electrode 10 tips, e.g., made of ceramic or some other material, with similarly high strength properties and to form a nonpositive fit with the tightly inserted electrodes 10 which is possible without a significant negative effect on the electrostatic field that can be generated at the electrode 10 tips. Another possibility is the arrangement of the electrode 10 tips in hollows of the surrounding insulating surface 82, which can be cast with a mass that does not weaken the electrostatic field or optionally can also be covered with a thin protective film.

The needle electrodes 10 can be electrically connected via a charging resistor 12 inserted into the hole of the projection 81 of the ring body 8 to a circular ring conductor 14 concentric to the axis of rotation, which sits insulated in the holder body 6 and on its side is connected to the high-voltage cable 17 via one or more other high-voltage conductors 15 arranged in the radial direction and an axial connection device, which can contain another resistor 16 located in the cable holder 63. The ring conductor 14 connects all electrodes 10 to the cable 17.

The uniform distribution of a larger number of charging electrodes 10 each with corresponding charging resistors 16 increases, among other things, the process reliability if during operation the electrode 10 arrangement approaches impermissibly close to the grounded workpiece, which could lead to arcing or short circuits. This situation is prevented in a known way by electronic control and regulation circuits of the high-voltage generator. Instead of each electrode 10 being assigned to a separate charging resistor 16, however, it is also possible to connect two or more electrodes 10 via a common charging resistor 16 to the high-voltage supply device of the atomizer.

The high-voltage generator typically consisting of a compact cascade construction must not be connected via an external cable, such as 17, to the electrode 10 arrangement, but instead can also be built into or onto the atomizer directly. It is also possible to provide for each electrode 10 or for individual electrode 10 groups a separate high-voltage generator, e.g., in recesses close to the electrodes 10 similar to the hole of the projection 81.

It can be seen that the radial distance of the tips of the needle electrodes 10 from the axis of rotation of the atomizer and thus from the spray edge 4' of the cone plate 4 is significantly smaller than for currently typical comparable atomizers. The radial distance of the electrode 10 tips from the spraying edge 4' is for the shown example smaller than its diameter, in contrast, e.g., to EP 0171042 and 0238031, where it should be greater than twice the edge diameter. For air atomizers working with external charging, a corresponding situation applies with the stipulation that the radial distance of the charging electrodes 10 distributed around the longitudinal axis of the atomizer, i.e., the center axis of the paint nozzle, from the electrically conductive parts on the periphery of the spray head should be correspondingly small. Furthermore, it is essential that the electrode 10 tips be set back in the axial direction at such a distance behind the spray edge 4' of the cone plate 4 (or behind the electrically conductive parts of the spray head, e.g., an air atomizer) that the required air isolation path between the possibly grounded spray head and the electrode 10 arrangement is maintained and the ion current flowing between them through the charged air remains limited to permissible values. In reference to the control and regulation measures required for process security, reliable grounding of the relevant components of the atomizer can be important, wherein these components, such as, among other things, the line supplying the coating material to the spray head and adjacent components, can consist advantageously of poor electrically conductive or nonconductive materials, such as plastic or ceramic.

Figure 2:
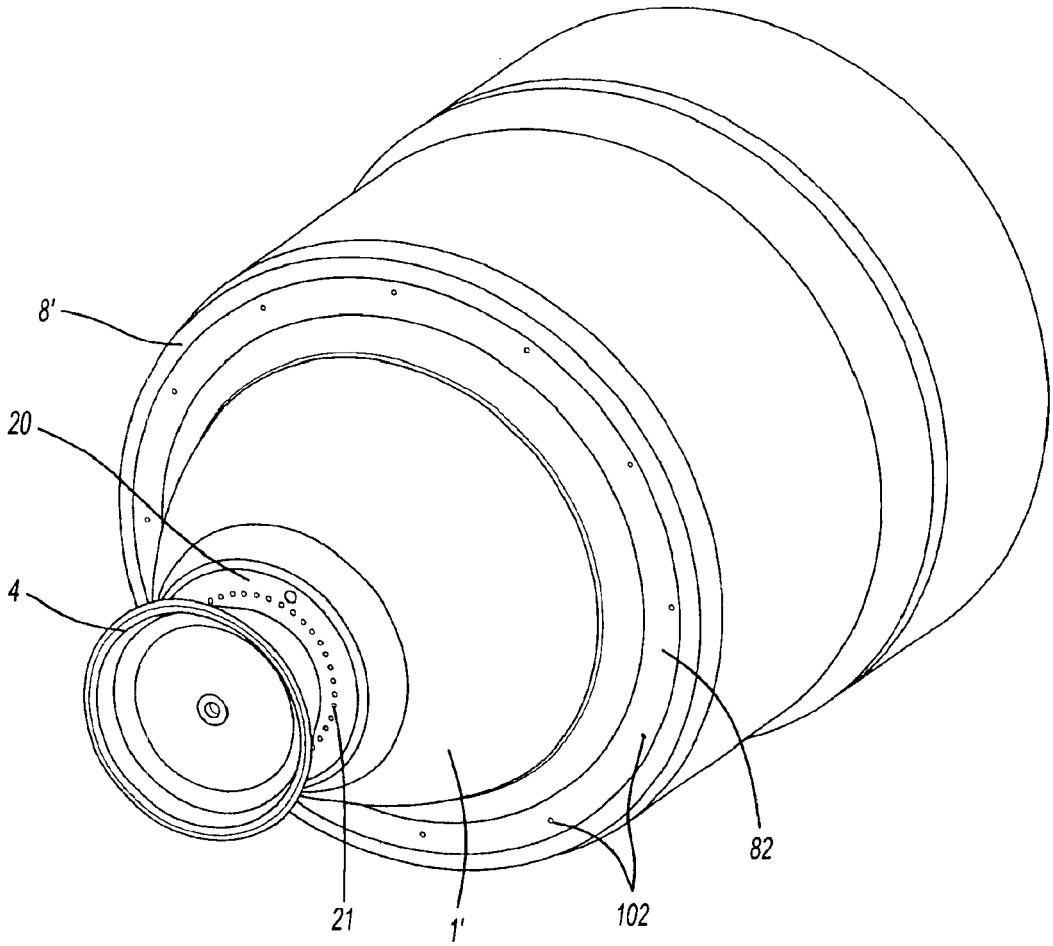
FIG. 2, an outer view of an atomizer essentially corresponding to FIG. 1.

In FIG. 2, the electrode arrangement of an atomizer essentially corresponding to FIG. 1 is seen three-dimensionally here with, e.g., twelve electrode tips 102 distributed uniformly around the axis of rotation in the end surface 82 of the ring body 8' set on the housing body 1'.

Furthermore, a guidance air ring 20 inserted in the front opening of the housing body 1' can be seen in FIG. 2 with air nozzles 21 distributed on a collar concentrically around the axis of rotation. The guidance air ring has the known function of bringing the spray jet into the desired form and imparting an axial component in the direction towards the workpieces to be coated to the sprayed coating material. The guidance air can be a reason for worse charging, particularly for known atomizers, because it dries the sprayed paint particles and thus reduces their ability to be charged with increasing distance from the spray edge. According to the invention, it has proven to be advantageous if the paint droplets at the spray edge, thus still in the essentially "wet" state, are led directly into a region of high field-line density due to the radial proximity of the electrode 10 arrangement, where they can be easily charged by the particularly strongly ionized air at that position.

It can be advantageous to impart an additional motion component in the direction towards the spray head and thus towards the paint particles sprayed there to the ion stream of the air molecules ionized by the electrode 10 tips through another collar of nozzle-like (not shown) air holes concentric to the axis of rotation, which are located in the ring part containing the electrode 10 tips, such as the ring body 8, preferably directly at the electrode 10 tips or in their proximity. This air advantageously guided like a jacket over the surface of the outer housing 1, in FIG. 1 the outer housing body 1, simultaneously prevents contamination of the outer housing 1 in this region and is also used as an additional guidance device for stray paint particles in the axial direction towards the workpiece. Instead of a collar of air holes, a circular annular, nozzle-like air gap can also be provided.

Instead of air, the described nozzle arrangements can also be supplied with another suitable guide gas. In addition, it can be meaningful, for increasing the electrical conductivity of the air molecules in the area of the electrode 10 tips, to blow gas, e.g., air with increased moisture or a gas that increases the conductivity, from the described nozzle arrangement and/or to add a gas that increases the conductivity to the discharged air. The use of gases that increase the corona effect is also conceivable.

A conductive paint particle layer on the outer side of the atomizer housing could form conductive bridges between the electrodes 10 and grounded parts of the atomizer. Similar to an air or gas jacket around the atomizer housing 1, contamination of the housing 1 can also be prevented by surrounding the housings and preferably the entire outer surface of the atomizer with a jacket of a porous air-permeable material (cf. also EP 0283918 mentioned in the introduction). Another possible means against contamination or self-coating of the outside of the atomizer is to produce the surfaces of the housing 1 and/or other delicate outer parts from a material, which has the property of especially low wettability and/or affects the static electrical charge in the sense of low contamination risk. In addition to other materials or coatings known from interface chemistry, particularly for water-soluble paint, e.g., materials with the known "lotus effect," correspondingly microstructured surfaces have proven to be suitable (which can also be realized with PTFE).

Instead of the needle electrodes 10 of the embodiments described here, it is also conceivable to use in the relevant insulating ring part a circular electrode ring concentric to the atomizer axis with a sharply delimited knife edge.

Figure 3:
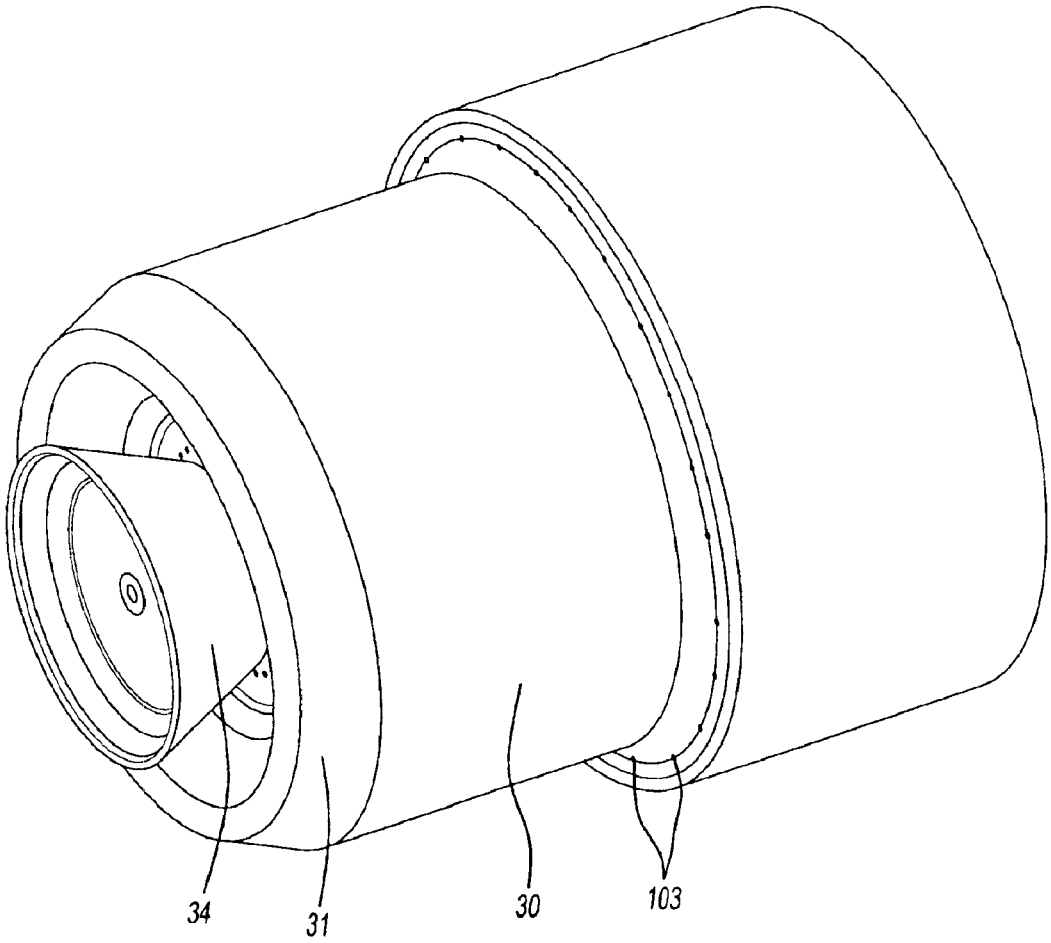
FIG. 3, an outer view of another embodiment of a rotary atomizer.

FIG. 3 shows an embodiment modified from FIG. 2, for which the outer housing 30 extends with an end ring 31, which is formed, e.g., as one piece with the housing 30 and which projects in the axial direction at its front end like a shield over a rear part of the spray head, here the cone plate 34. The cone plate 34, which, as conventionally, can consist of metal or some other electrically conductive material, is shielded by the end ring 31, so that it does not directly face the electrode tips 103 and a region of greatest field-line density. The end ring 31 thus lies in the direct (straight line) connection path between the cone plate 34 the electrode tips 103. Through these means, it is possible to arrange the electrode tips 103 in the axial direction closer to the cone plate 34 or spray head. In addition, FIG. 3 shows that an even greater number of electrode tips 103 is possible than in FIG. 2.

Figure 4:
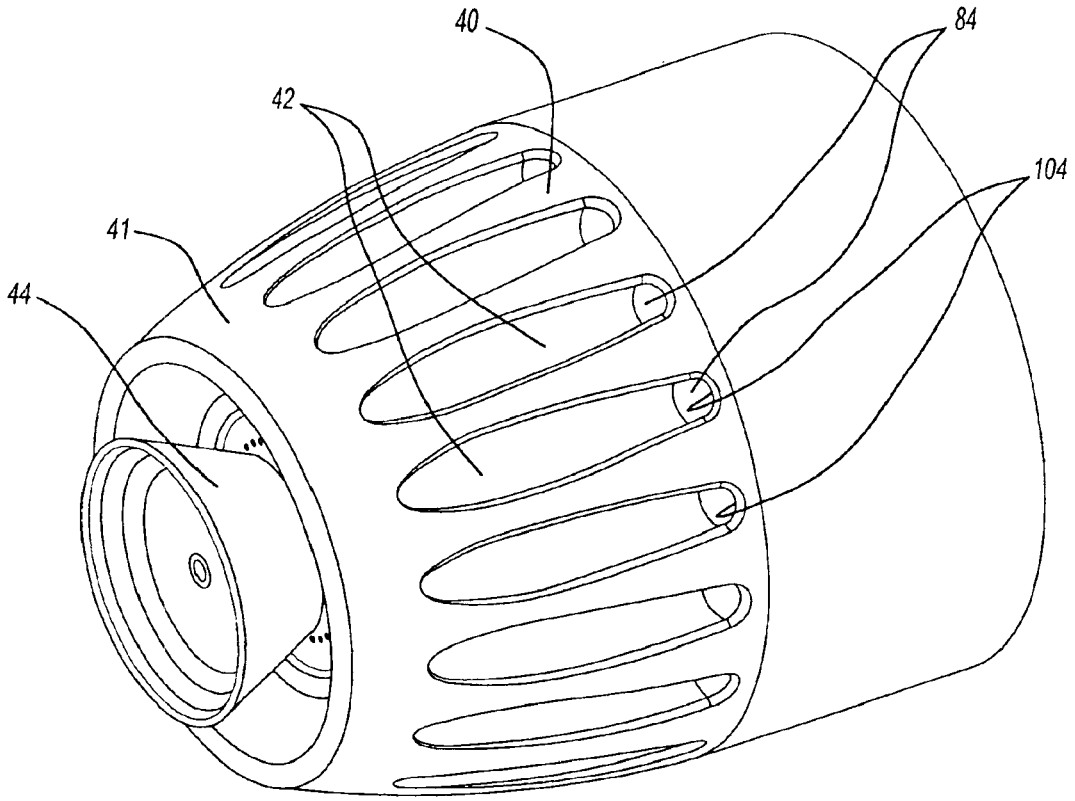
FIG. 4, another embodiment of a rotary atomizer.

In a refinement of the invention and the embodiment from FIG. 3, according to FIG. 4, the periphery of outer housing 40 of the atomizer contains elongated recesses 42 in the axial direction with the illustrated trough-like shape, in which at its rear end the tip of one of the needle electrodes 104 distributed around the axis of rotation is exposed. The trough shape of the recesses 42 should be as easy to clean as possible. The electrodes 104 sunk with its tips in these recesses 42 can be embedded in a separate ring body, e.g., as in FIG. 1 or instead also directly in the outer housing 40 itself. The ring body or the outer housing 40 forms end surface areas 84, which surround the electrode 104 tips in the radial direction, thus facing the workpieces to be coated, and which border the trough-shaped recesses 42 at their end. Similar to FIG. 3, here the cone plate 44 itself is also shielded (in contrast to the sprayed paint particles) by an end ring 41 extending in the axial direction against too high a field-line concentration.

Figure 5:
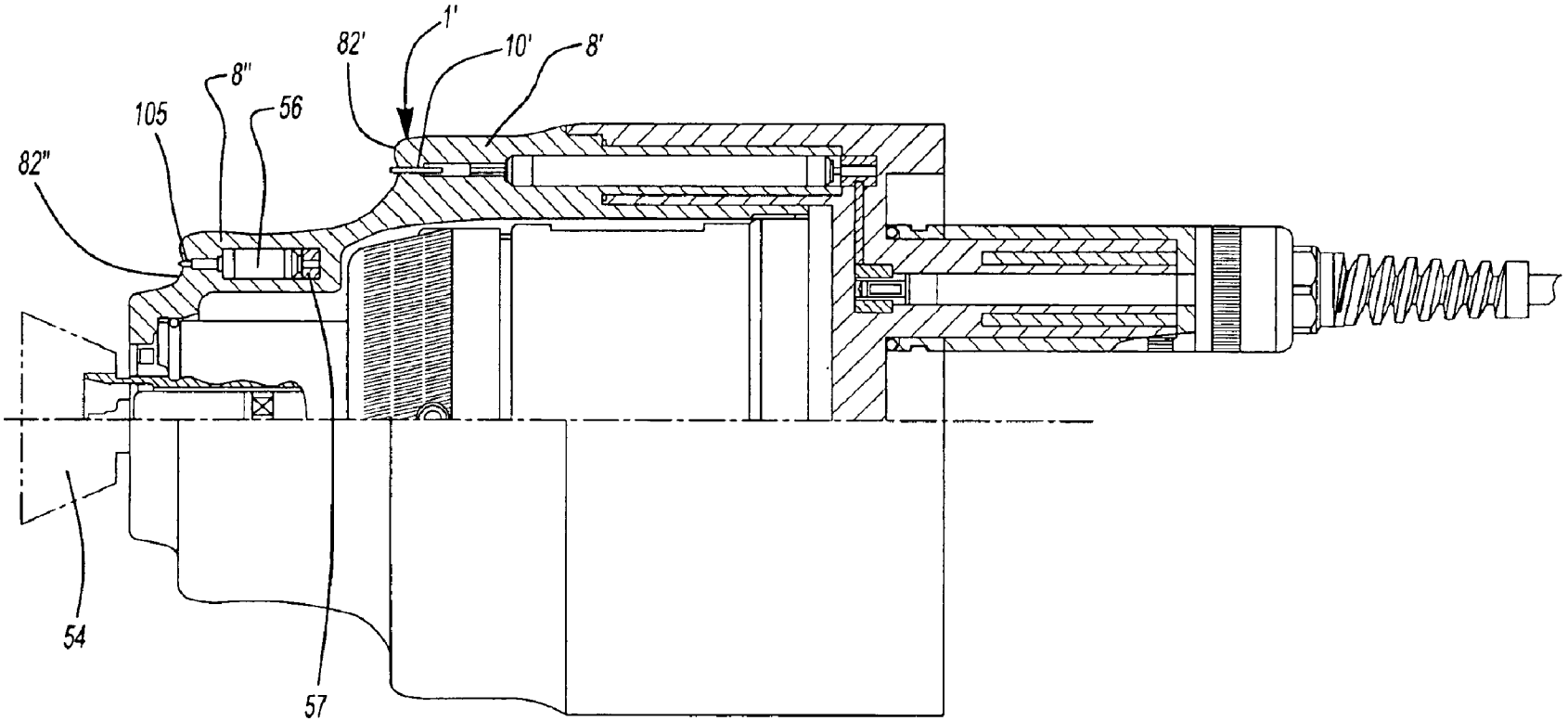
FIG. 5, the partial section of an embodiment of the invention with two different electrode arrangements.

Another embodiment illustrated in FIG. 5 of an atomizer of the invention corresponds in the rear part of the atomizer and particularly with reference to the high-voltage supply device to the embodiment from FIG. 1. The needle electrodes 10', however, do not sit, as in FIG. 1, in a separate ring body, but instead in a part 8' of the outer housing body 1', which is formed similarly on the ring body 8, which forms, as in FIG. 1, a rounded and continuous end surface 82' transitioning into the front peripheral part of the housing body 1'.

Furthermore, in a refinement to the invention, for the embodiment shown in FIG. 5, in addition to the electrodes 10', a second arrangement similar to this one of needle electrodes 105 distributed concentrically at equal mutual angular intervals around the axis of rotation is provided. The needle electrodes 105 and/or the electrodes 10' can lie axially parallel according to the illustration or they can form an advantageous angle with the longitudinal direction. The needle electrodes 105 can likewise be embedded like the electrodes 10' according to the illustration in a ring part 8" forming the peripheral wall of the housing body 1' itself or instead in a separate ring body set on the housing body 1'. The ionization ends of this additional electrode 105 arrangement preferably lie in a radial plane, which lies in the axial direction against the ends of the electrodes 10' offset between these and the cone plate 54, and as illustrated their radial distance from the axis of rotation can be smaller than that of the ionization ends of the rear electrodes 10'. The electrodes 105 are connected, similarly to the electrodes 10', via charging resistors 56 to a ring conductor 57, which is located in the ring part 8" concentric to the axis of rotation and which on its side is connected to a high-voltage device in a way that is not shown.

With the two electrode 10', 105 arrangements separated from each other in the described way, an improved regulation behavior can be achieved, because the operating current (for a large part flowing into the grounded cone plate) is better distributed. In addition, in principle, similarly to the known combined internal and external charging (DE 4105116), the charging is improved, but preferably with a grounded cone plate, wherein the front electrode ring with the needle electrodes 105 is used primarily for charging the coating material and the rear and external electrode ring is also used for guidance and shielding of the spray jet. Preferably, the two (or more) separate electrode 10', 105 arrangements of the described type are each connected to a separate high-voltage generator and set to different potentials, wherein the electrodes 10', 105 lying closer to the spray head, as a rule, are at a lower potential. However, it is also possible to connect the two electrode 10', 105 arrangements to a common high-voltage generator.

The invention has been described in an illustrative manner, and it is to be understood that the terminology which has been used is intended to be in the nature of words of description rather than limitation.

Obviously, many modifications and variations of the present invention are possible in light of the above teachings it is, therefore, to be understood that within the scope of the appended claims, wherein reference numerals are merely for convenience and not to be in any way limiting, the invention may be practiced otherwise than as specifically described.

What is claimed is:

1. An atomizer for the electrostatic series coating of workpieces, comprising:

an outer housing formed of an insulating material including a longitudinal axis, an end portion and an axial tube extending through said end portion receiving conductive coating material;

a cone-shaped spray head rotatably supported by said housing in said longitudinal axis opposite said tube;

a ring part formed of an insulating material surrounding said housing in engagement with said housing preventing overspray of coating material from being received between said ring part and said housing having a generally radial end portion spaced rearwardly from said end portion of said housing; and an electrode arrangement embedded in said ring part conneted to a high voltage supply having an end extending through said generally radial end of said ring part concentric with said spray head and spaced rearwardly from said end portion of said housing and said spray head externally charging conductive coating sprayed by said spay head through ionization of air surrounding said spray heed.

2. The atomizer as defined in claim 1, wherein said electrode arrangement comprises a plurality of needle-shaped electrodes equally circumferentially spaced in said ring part each having a tip portion extending trough said generally radial end portion of said ring part.

3. The atomizer as defined in claim 2, wherein said tip portion of said electrodes are substantially flush with said generally radial end portion of said ring part.

4. The atomizer as defined in claim 2, wherein said electrodes are connected to a common annular conductor located within said outer housing.

5. The atomizer as defined in claim 1, wherein said ring part forms an outer wall of said housing.

6. The atomizer as defined in claim 1, wherein said housing includes a radial portion spaced rearwardly of said end portion having a second electrode arrangement embedded in said housing including an end portion extending through said generally radial portion spaced forwardly of said electrode arrangement.

7. The atomizer as defined in claim 1, wherein said electrode arrangement has an outer diameter less than twice an outer diameter of said cone-shaped spray bead.

8. An atomizer for the electrostatic series coating of workpieces, comprising:

an outer housing formed of an insulating material including a longitudinal axis, an end portion and an axial tube extending through said end portion receiving conductive coating material;

a cone-shaped spray head rotatably supported by said housing in said longitudinal axis opposite said spray head;

a ring part formed of an insulating material surrounding said housing in engagement with said housing preventing overspray of coating material from being received between said ring part and said housing having a generally radial end portion spaced rearwardly from said end portion of said housing; and a plurality of equally circumferentially spaced needle-shaped electrodes embedded in said ring part each having a tip portion extending through said generally radial end portion of said ring part concentric with said spray head and spaced rearwardly from said end portion of said housing and said spray head connected to a high voltage supply externally charging coating materials sprayed by said spray head by ionization of air surrounding said housing.

9. The atomizer as defined in claim 8, wherein said tip portion of said electrodes are substantially flush with said generally radial end portion of said ring part.

10. The atomizer as defined in claim 8, wherein said electrodes are connected to a common annular conductor located within said outer housing.

11. The atomizer as defined in claim 8, wherein said ring part forms an outer wall of said housing.

12. The atomizer as defined in claim 8, wherein said housing includes a generally radial portion spaced rearwardly of said end portion and forwardly of said ring part including a second plurality of equally circumferentially spaced needle-shaped electrodes embedded in said housing portion each having an end portion contending through said generally radial portion of said housing spaced forwardly of said plurality of equally circumferentially spaced needle-shaped electrodes.

13. The atomizer as defined in claim 8, wherein said plurality of equally circumferentially spaced needle-shaped electrodes has an outer diameter less than twice an outer diameter of said cone-shaped spray heads.

* * * * *

UNITED STATES PATENT AND TRADEMARK OFFICE

CERTIFICATE OF CORRECTION

PATENT NO. : 6,896,735 B2
DATED : May 24, 2005
INVENTOR(S) : Stefano Giuliano and Peter Marquardt It is certified that error appears in the above-identified patent and that said Letters Patent is hereby corrected as shown below:

Column 8,
Line 4, please delete “trough” and insert -- through --.
Line 58, please delete “contending” and insert -- extending --.

Signed and Sealed this

Twenty-seventh Day of September, 2005

JON W. DUDAS
*Director of the United States Patent and Trademark Office*